US009447367B2

(12) United States Patent
Budich

(10) Patent No.: US 9,447,367 B2
(45) Date of Patent: Sep. 20, 2016

(54) ALKALINE CLEANER COMPRISING A TERNARY COMBINATION OF COMPLEXING AGENTS

(71) Applicant: BUDICH INTERNATIONAL GMBH, Hiddenhausen (DE)

(72) Inventor: Meinrad Budich, Hüllhorst (DE)

(73) Assignee: BUDICH INTERNATIONAL GMBH, Hiddenhausen (DE)

( * ) Notice: Subject to any disclaimer, the term of this patent is extended or adjusted under 35 U.S.C. 154(b) by 0 days.

(21) Appl. No.: 15/027,809

(22) PCT Filed: May 21, 2014

(86) PCT No.: PCT/EP2014/060459

§ 371 (c)(1),
(2) Date: Apr. 7, 2016

(87) PCT Pub. No.: WO2015/104068

PCT Pub. Date: Jul. 16, 2015

(65) Prior Publication Data

US 2016/0237383 A1 Aug. 18, 2016

(30) Foreign Application Priority Data

Jan. 10, 2014 (DE) ..... 10 2014 100 234

(51) Int. Cl.

| | |
|---|---|
| ***C11D 3/33*** | (2006.01) |
| ***C11D 7/06*** | (2006.01) |
| ***C11D 7/12*** | (2006.01) |
| ***C11D 7/14*** | (2006.01) |
| ***C11D 11/00*** | (2006.01) |
| ***C11D 3/37*** | (2006.01) |
| ***C11D 3/20*** | (2006.01) |
| ***C11D 3/08*** | (2006.01) |
| ***C11D 3/04*** | (2006.01) |

(52) U.S. Cl.

CPC ..... *C11D 11/0041* (2013.01); *C11D 3/044* (2013.01); *C11D 3/08* (2013.01); *C11D 3/2086* (2013.01); *C11D 3/33* (2013.01); *C11D 3/3707* (2013.01); *C11D 3/3723* (2013.01)

(58) Field of Classification Search

CPC ..... C11D 3/33; C11D 7/06; C11D 7/12; C11D 7/14; C11D 11/0023; C11D 11/0029; C11D 17/0073

See application file for complete search history.

(56) References Cited

U.S. PATENT DOCUMENTS

| | | | | |
|---|---|---|---|---|
| 5,062,962 | A | 11/1991 | Brown et al. | |
| 5,147,555 | A * | 9/1992 | Brown | C23F 11/08 210/698 |
| 8,012,267 | B2 | 9/2011 | Jekel et al. | |
| 8,349,785 | B2 | 1/2013 | Kessler et al. | |
| 2003/0064911 | A1 | 4/2003 | Rouillard et al. | |
| 2012/0199165 | A1 | 8/2012 | Kessler et al. | |

FOREIGN PATENT DOCUMENTS

| | | | |
|---|---|---|---|
| AU | 6565700 | A | 2/2001 |
| DE | 691 10 550 | T2 | 1/1996 |
| DE | 10 2005 060 431 | A1 | 6/2007 |
| DE | 10 2006 028 750 | A1 | 12/2007 |
| DE | 10 2009 027 158 | A1 | 12/2010 |
| DE | 10 2013 100 195 | A1 | 7/2014 |
| GB | 2462173 | A | 2/2010 |
| WO | 01/09275 | A1 | 2/2001 |
| WO | 01/98558 | A2 | 12/2001 |
| WO | 2007/073801 | A1 | 7/2007 |
| WO | 2010/051141 | A1 | 5/2010 |
| WO | 2013/185074 | A2 | 12/2013 |

OTHER PUBLICATIONS

International Search Report—PCT/EP2014/060459 mailed Oct. 13, 2014.

German Search Report—German Patent Application No. 10 2014 100 234.2 issued on Dec. 23, 2014.

* cited by examiner

*Primary Examiner* — Charles Boyer

(74) *Attorney, Agent, or Firm* — Studebaker & Brackett PC

(57) ABSTRACT

The invention concerns a machine cleaner to clean kitchen appliances, comprising an alkaline system and a complexing component to bind metals or metallic cations, wherein the complexing component comprises a combination of at least one element from each of the following groups of complexing agents or complexing aids: methyl glycine diacetic acid or polyaspartic acid or salts thereof; polyepoxysuccinic acid or salts thereof; and gluconic acid or gluconates. The invention also concerns the use of a combination of different complexing agents or complexing aids in an alkaline machine cleaner as well as the use of a machine cleaner in accordance with the invention to clean kitchen appliances, in particular in the commercial kitchen sector.

11 Claims, No Drawings

ALKALINE CLEANER COMPRISING A TERNARY COMBINATION OF COMPLEXING AGENTS

The present invention relates to alkaline machine cleaners for cleaning kitchen appliances, which comprise a special combination of phosphate substitutes, their use in kitchen appliances, in particular in the commercial kitchen sector, and to the use of a special combination of phosphate substitutes in an alkaline machine cleaner.

An example of an alkaline cleaning tablet with a complexing agent based on a phosphate or phosphonate has been described in German patent application No. 10 2013 100 195.5. Until now, phosphates and phosphonates have been able to be used as complexing agents in these alkaline cleaners. However, these are not suitable for global marketing, since in some states (for example the USA, Canada), phosphorus has been banned from cleaning agents or is severely limited.

For this reason, one aim of the present application is to provide an alkaline machine cleaner which comprises a cleaning system based on phosphate substitutes.

A machine cleaner in accordance with the invention is a cleaning agent or a cleaning agent system for cleaning kitchen appliances such as commercial dishwashers, ovens, grills, convection ovens, catering equipment, degreasing equipment, as well as contaminated surfaces in the commercial kitchen sector. As a rule, alkaline to highly alkaline cleaners are used in this field of application, which cleaners usually have a special cleaning power compared, for example, with conventional dishwasher tablets for use in the dishwasher to clean dirty crockery.

In a first aspect of the invention, a machine cleaner for cleaning kitchen appliances comprises an alkaline system and a complexing component for binding metals or metallic cations. In accordance with the invention, the complexing component comprises a combination of a plurality of complexing agents or complexing aids. It has surprisingly been shown that with a combination of three phosphate substitutes, a synergistic effect is obtained as regards the metal binding capacity in alkaline cleaners, in particular of divalent metals such as magnesium and calcium. Thus, in accordance with the invention, the machine cleaner comprises a combination of at least one element from each of the following groups of complexing agents or complexing aids:

- methyl glycine diacetic acid or polyaspartic acid or salts thereof,
- polyepoxysuccinic acid or salts thereof, and
- gluconic acid or gluconates.

These complexing agents are all known as phosphate substitutes, but their special complexing action when used in combination, in particular as regards the magnesium and calcium binding capacity, was not known to the person skilled in the art. Thus, it was surprising that in tests, it was able to be shown that, in particular with a combination of the complexing agents methyl glycine diacetic acid, polyepoxysuccinic acid and Na gluconate or polyaspartic acid, polyepoxysuccinic acid and Na gluconate, a higher calcium-binding capacity can be obtained in each case than with the respective individual complexing agents in the same concentration.

In a preferred embodiment, the cleaner comprises an alkaline system formed from one or more components which are selected from sodium hydroxide (NaOH), caustic soda (highly concentrated NaOH) and metasilicate. These components provide the cleaner with a high alkalinity. The term "alkaline cleaner" as used in the context of the invention is a powder or a tablet with an alkaline system which, when dissolved in water, i.e. in a 1% aqueous solution, preferably produces an alkaline pH, more preferably a pH of more than 10, particularly preferably more than 12. In this manner, in the alkaline cleaning tablet, one of these alkaline components or a combination of a plurality of these alkaline components may be used, or a combination with additional alkaline agents may be used in order to specifically adjust the alkalinity (also known as "basicity"). In order to dissolve fats and proteins from dirty surfaces, adjusting the pH to the preferred alkaline value mentioned above is often sufficient; even alkaline cleaning agents may exhibit a cleaning action based on complexing groups or surfactant groups, as long as their action can occur in an alkaline medium (pH more than 10).

The cleaner of the invention preferably contains the alkaline components of the alkaline system in a total quantity of approximately 20% to 70% by weight, particularly preferably in a proportion of approximately 40% to 60% by weight with respect to the complete cleaner, i.e. machine cleaner.

Preferably, these highly alkaline components are mixed with a powder or a tablet matrix; the scope of the invention also encompasses these components being transformed partially or completely into more stable products in the tablet matrix upon tableting, for example into hydrates or oxides, etc., as long as this transformation is reversible when the cleaning tablet is used in water so that the desired alkalinity (also known as "basicity") is provided. The tablet matrix may also be constructed from the alkaline components themselves. In order to dissolve fats and proteins from dirty surfaces, adjusting the pH to the preferred alkaline value mentioned above is often sufficient; even alkaline cleaning agents may exhibit a cleaning action based on complexing groups or surfactant groups. Protein-denaturing alkaline materials may also be used as cleaning components, as long as they are active in an alkaline medium.

When used in regions of machines which are difficult to access, for example, pre-prepared cleaning solutions may also be provided in which the alkaline system and the complexing components are in the dissolved form. These cleaning solutions are thus ready for immediate use, since the components they contain do not have to be dissolved. The solutions may, for example, be packaged in bottles with an appropriate dispenser, or in water-soluble foil containers, preferably in individual portions.

In a further preferred embodiment, the machine cleaner in accordance with the invention may comprise further complexing agents, matrix components, structural materials and adjuvants.

The cleaner contains a complexing component with a combination of complexing agents or complexing aids, in order to bind metals and metallic ions, in particular calcium and magnesium, from hard water and from the food contamination which has been loosened by the cleaning procedure. In phosphorus-free cleaners for this purpose, as an example, one or more of the following complexing agents may be used as a further complexing agent in addition to the complexing components described herein: polymers and copolymers (for example polycarboxylates), phyllosilicates, citric acid/citrate, etc.

In countries in which the use of small quantities of phosphorus is permitted, alkali-stable phosphate or phosphonate-containing additives may be used, for example phosphonates (for example salts of nitrilotris-methylenephosphonic acid) of the Sequion type (manufacturer: Polygon) or of the Cublen type (manufacturer: Zschimmer & Schwarz) as additional complexing agents.

The complexing components and other complexing agents are preferably used in a total quantity of no more than 10% to 40% by weight, particularly preferably in a proportion of approximately 15% to 25% by weight with respect to the total weight of the cleaner.

Preferred proportions of combinations of the three groups of complexing agents or complexing aids may be as follows (the proportions are each with respect to the total weight of the cleaner):

methyl glycine diacetic acid or polyaspartic acid or salts thereof:

preferably 1% to 10%, more preferably 2% to 6%, polyepoxysuccinic acid or salts thereof:

preferably 1% to 10%, more preferably 2% to 6%, gluconic acid or gluconate:

preferably 1% to 15%, particularly preferably 2% to 10%.

In addition to the alkaline components and the complexing agents, surface-active substances are used for cleaning. These substances, also known as surfactants, should advantageously form as little foam as possible in order to avoid excessive foam formation from the outset. Preferred surfactants are fatty alcohol ethoxylates, in particular end group-terminated Plurafac types (manufacturer: BASF), glucosides (manufacturer: Akzo) or fatty amines. Anionic surfactants may be envisaged, but are of little relevance as they are often strong foam producers. Surfactants are preferably used in a quantity of approximately 0.2% to 20% by weight, particularly preferably in a proportion of approximately 0.5% to 5% by weight of the cleaner.

When in the form of a cleaner tablet, the machine cleaner preferably contains a tablet matrix with the usual matrix components. It may also additionally contain one or more structural materials (for example water-soluble sulphates such as Na sulphate, for example) and/or aids, particular examples of which are binders, tableting aids, disintegrant, dissolution inhibitors, retardants or lubricants.

The structural materials are preferably used in a quantity of no more than 20% by weight, particularly preferably in a proportion of no more than 10% by weight of the cleaning tablet. The aids are preferably used in a quantity of no more than 20% by weight, particularly preferably in a proportion of approximately 3% to 10% by weight of the cleaning tablet. The quantities in this case are with respect to the whole cleaning tablet.

Aids for tablets play a wide variety of roles which are recorded in the literature. Basically, they fall into the following categories of the various aids, which categories are based on their various functions. Binders or direct tableting aids include starches, celluloses, polyethylene glycol, calcium compounds, bentonite, polysaccharides, sugar compounds, proteins or synthetic polymers.

Examples of disintegrants include starches, (microcrystalline) celluloses, alginates, polysaccharides, proteins, cross-linked polyvinylpyrrolidine, polymethacrylate derivatives or bentonite.

Examples of dissolution inhibitors or retardants include waxes, ethyl celluloses, fats, polyvinyl acetate, carboxymethylcellulose, polyacrylic acid, polyethylene glycol, gels or stearates.

Examples of lubricants which may be cited include fatty acid esters, talc, oils and fats or fatty acids, or fused silica.

Depending on the desired properties of the cleaning tablets, for example as regards strength and solubility, and also to make them compressible, a suitable combination of the various aids or structural materials which is dependent on the field of application is used.

In addition, other functional compartments or substances such as a rinse aid, an ion exchange agent, a special cleaning agent for stubborn dirt, etc., may be integrated into the cleaning tablet. Separate compartments, for example separate layers or zones, may be provided in this regard.

Preferably, a bonding agent may be used to strengthen the cohesion within the tablet matrix or between different tablet layers. As an example, polyethylene glycol may be introduced into the tablet matrix as a powder for this purpose.

A machine cleaner in accordance with the invention may preferably be presented in the form of a powder or a tablet. When the machine cleaner is in the form of cleaning tablets, then they are preferably packaged individually or in a specific number in a heat-sealed film known as a flow pack (a pouch into which the products are introduced horizontally) so that they can be dispensed when required in a precise and simple manner.

Because of the advantages mentioned above and special embodiments, a combination of different complexing agents or complexing aids suitable for use in an alkaline machine cleaner with improved metal complexing capabilities. In accordance with the invention, the combination comprises at least one element from each of the following groups of complexing agents or complexing aids:

methyl glycine diacetic acid or polyaspartic acid or salts thereof, polyepoxysuccinic acid or salts thereof, and gluconic acid or gluconates.

According to a further aspect of the invention, the machine cleaner of the invention as described above is suitable for cleaning kitchen appliances, in particular in the commercial kitchen sector. Consequently, this type of application is preferred.

EXAMPLES

The calcium binding capacity was determined by titration as follows:

The cleaner was placed in distilled water as a 1% solution and 2 mL of a soda solution (10%) was added.

The pH was adjusted to 11 using sodium hydroxide.

The transmission was determined using a photometer (500 nm) and the starting value was set at 100%.

Calcium acetate solution (0.25 mole/liter) was added using a titration flask or an automated titration apparatus and the transmission was measured as a function of the added calcium acetate.

The pH was kept to 11 using sodium hydroxide and monitored using a pH meter.

As long as the solution can bind calcium, no cloudiness appears and the transmission remains constant. When the calcium binding capacity drops, the cloudiness increases and reduces the transmission value.

Since the point of inflexion for the onset of cloudiness often cannot be determined as a distinct point and therefore this has to be interpolated as the intersection of two regression lines, the value at which the cloudiness is strong enough to drop the transmission to 50% of the starting value is determined in order to act as a comparative value for the calcium binding capacity.

The calcium binding capacity of the complexing agent or respectively the comparative value described above was tested in a cleaner with an identical alkaline system, but different complexing agents, with the following composition (cleaners A to C (comparative), cleaners E and F (of the invention):

| Cleaner | A | B | C | E | F |
|---|---|---|---|---|---|
| Caustic soda (NaOH) | | | 30% | | |
| Metasilicate | | | 30% | | |
| Soda (Na carbonate) | | | 20% | | |
| Fatty alcohol ethoxylate | | | 4% | | |
| Na gluconate | 16% | | | 8% | 6% |
| Polyepoxysuccinic acid | | 16% | | 4% | 5% |
| Methyl glycine diacetic acid | | | 16% | 4% | 5% |

The comparative value determined by the titration method described above for the calcium binding capacity provided the following values (expressed as calcium carbonate per g of cleaner; mean of two measurements):

| Cleaner | A | B | C | E | F |
|---|---|---|---|---|---|
| mg $CaCO_3$/g | 48 | 71 | 79 | 89 | 92 |

Surprisingly, it can be seen that the calcium binding capacity of the combination of three complexing agents provides a significantly higher value for the same total concentration than that which can be obtained for the best complexing agents individually (methyl glycine diacetic acid—cleaner C).

The same effect can be obtained when the methyl glycine diacetic acid in the system is replaced by polyaspartic acid (cleaners G and H, in accordance with the invention). In the table below, cleaner D is also present as a further comparison:

| Cleaner | A | B | D | G | H |
|---|---|---|---|---|---|
| Caustic soda (NaOH) | | | 30% | | |
| Metasilicate | | | 30% | | |
| Soda (Na carbonate) | | | 20% | | |
| Fatty alcohol ethoxylate | | | 4% | | |
| Na gluconate | 16% | | | 8% | 6% |
| Polyepoxysuccinic acid | | 16% | | 4% | 5% |
| Polyaspartic acid | | | 16% | 4% | 5% |

The comparative value determined by the titration method described above for the calcium binding capacity provided the following values (expressed as calcium carbonate per g of cleaner; mean of two measurements):

| Cleaner | A | B | D | G | H |
|---|---|---|---|---|---|
| mg $CaCO_3$/g | 48 | 79 | 76 | 91 | 95 |

With this combination as well, it can be seen that the calcium binding capacity of the combination of the three complexing agents provides a significantly higher value for the same total concentration than that which can be obtained for the best complexing agent (polyaspartic acid—cleaner D) individually.

The invention claimed is:

1. A machine cleaner to clean kitchen appliances, comprising;

A) an alkaline system; and

B) a complexing component to bind metals or metallic cations, wherein the complexing component comprises a combination of at least one element from each of the following groups of complexing agents or complexing aids:

a) methyl glycine diacetic acid or polyaspartic acid or salts thereof, and b) polyepoxysuccinic acid or salts thereof, and c) gluconic acid or gluconates.

2. The machine cleaner as claimed in claim 1, wherein the alkaline system comprises one or more components selected from the group consisting of sodium hydroxide, caustic soda and metasilicate.

3. The machine cleaner as claimed in claim 1, wherein the alkaline system provides the cleaner with a pH of more than 10 in a 1% aqueous solution.

4. The machine cleaner as claimed in claim 1, wherein the alkaline system is present in a total quantity of approximately 20% to 70% by weight with respect to the totality of the cleaner.

5. The machine cleaner as claimed in claim 1, wherein the cleaner further comprises at least one component selected from the group consisting of a further complexing agent, a matrix component, and structuring materials and aids.

6. The machine cleaner as claimed in claim 5, wherein the further complexing agent is selected from the group consisting of polymers, copolymers, phyllosilicates, citric acid or salts thereof.

7. The machine cleaner as claimed in claim 1, wherein the cleaner further comprises phosphate or phosphonate-containing additives.

8. The machine cleaner as claimed in claim 1, wherein the cleaner comprises a number of functional components or substances selected from the group consisting of rinse aids, ion exchange agents, special cleaning agents, surface-active substances, disintegrants, bonding agents, dissolution inhibitors, retardants, and lubricants.

9. The machine cleaner as claimed in claim 1, wherein the machine cleaner is presented in the form of a powder or a tablet.

10. The machine cleaner as claimed in claim 9, wherein the tablets are packed in a heat-sealed foil individually or in a specific number.

11. A method for cleaning kitchen appliances, in particular in the commercial kitchen sector, comprising contacting said kitchen appliance with the cleaner of claim 1.

* * * * *